US005683188A

United States Patent [19]

Miyazaki et al.

[11] Patent Number: 5,683,188

[45] Date of Patent: Nov. 4, 1997

[54] SERIAL PRINTING DEVICE HAVING DATA DISCRIMINATION

[75] Inventors: Kenichi Miyazaki; Katsuhiko Iida; Shigeki Kanai, all of Nagano, Japan

[73] Assignee: Seiko Epson Corporation, Tokyo, Japan

[21] Appl. No.: 594,399

[22] Filed: Jan. 31, 1996

[30] Foreign Application Priority Data

Feb. 2, 1995 [JP] Japan ..... 7-037601
Dec. 26, 1995 [JP] Japan ..... 7-351654

[51] Int. Cl.[6] ..... B41J 2/015

[52] U.S. Cl. ..... 400/279; 400/582; 347/41; 347/42

[58] Field of Search ..... 347/5, 9, 14, 41, 347/42, 43; 400/279, 76, 582

[56] References Cited

U.S. PATENT DOCUMENTS

| | | | |
|---|---|---|---|
| 4,511,907 | 4/1985 | Fukuchi | 346/140 R |
| 4,639,746 | 1/1987 | Yamamoto | 346/140 R |
| 4,750,009 | 6/1988 | Yoshimura | 346/140 R |
| 5,075,689 | 12/1991 | Hoisington et al. | 347/43 |
| 5,455,610 | 10/1995 | Harrington | 347/43 |
| 5,512,923 | 4/1996 | Bauman | 347/43 |

FOREIGN PATENT DOCUMENTS

| | | |
|---|---|---|
| 0216176 | 4/1987 | European Pat. Off. . |
| 0554907 | 8/1993 | European Pat. Off. . |
| 0610096 | 8/1994 | European Pat. Off. . |
| 1216852 | 8/1989 | Japan . |

*Primary Examiner*—John S. Hilten
*Attorney, Agent, or Firm*—Sughrue, Mion, Zinn, Macpeak & Seas

[57] ABSTRACT

A serial printing device that has a wider printing region without elongating the platen shaft. The serial printing device includes a serial printing head (7, 8) mounted on a carriage, a medium feed control device (23), a carriage control device (24), and a data discriminating device (21). The serial printing head includes a plural number of dot forming element series each having a plural number of dot forming elements linearly arrayed in a printing medium feeding direction. The dot forming element series are arrayed in a printing medium width direction. The medium feed control device controls a first printing process wherein, when the carriage is accelerated and moved from a home position at a constant speed for printing, print data is outputted to the serial printing head to print an image of one line by one printing path. In a second printing process, print data is outputted to only the dot forming element series located furthest from the home end of the serial printing head, and an image of one line is printed by a plural number of printing paths as the printing medium is fed in small increments. The data discriminating device discriminates the type of printing process, i.e., the first or the second printing process, based on the print data, and selects the discriminated printing process.

8 Claims, 5 Drawing Sheets

SERIAL PRINTING DEVICE HAVING DATA DISCRIMINATION

BACKGROUND OF THE INVENTION

1. Field of the Invention

The present invention relates to a serial printing device and a method for controlling the device.

2. Description of the Related Art

An ink jet printing device that is provided with ink jet printing heads for monochromatic and color printing is known. In this type of printing device, the carriage is relatively long when viewed in the paper width direction, since two printing heads must be mounted side-by-side on the carriage. Accordingly, the size of the printing device is increased.

Because of the problems of the long carriage and the increased printer size, the minimum required movable distance of the carriage must be determined based on a printing distance of the color printing head, since uniform printing over the entire width of the printing paper is required for color printing. The distance that the printing head moves in printing text with margins on both sides is shorter than the moving distance of the color printing head.

The printable region of the monochromatic printing head is narrower than that of the color printing head. As a result, it is difficult to print graphic data in the monochromatic printing mode.

SUMMARY OF THE INVENTION

An object of the present invention is to provide a serial printing device which has a wider printing region without an elongated platen shaft.

To achieve the above object, the serial printing device according to the present invention comprises: a serial printing head including a plural number of dot forming element series each having a plural number of dot forming elements linearly arrayed at fixed pitches in a printing medium feeding direction, the plural number of dot forming element series being arrayed in a printing medium width direction while being shifted from each other in the printing medium feeding direction; a carriage with a serial printing head mounted thereon being reciprocally movable along a platen; control means for controlling a first printing process wherein, when a moving speed of carriage reaches a constant speed for the printing, print data is outputted to the serial printing head, to thereby print an image of one line by one printing path, and for controlling a second printing process in which print data is outputted to only the dot forming element series located closest to the end of the serial printing head, and an image is printed by a plural number of printing paths while the printing medium is fed in small increments every time the motion of each printing path is completed; and data discriminating means for discriminating the type of the printing process, i.e., the first or the second printing process, on the basis of the print data, and selecting the discriminated printing process.

The serial printing device thus constructed can effectively use the space between the dot forming element series, and hence succeeds in reducing the moving distance of the carriage as much as possible, while securing an increased printing area relative to the printing area for normal printing.

The outermost dot forming element series when viewed in the moving direction of the printing head is used for printing, and the printable region is therefore increased by a distance at least equal to the space between the dot forming element series of the printing head, which distance is used to accelerate the printing head.

BRIEF DESCRIPTION OF THE DRAWING FIGURES

A preferred embodiment of the present invention will be described with reference to the accompanying drawings, in which.

Figure 5:
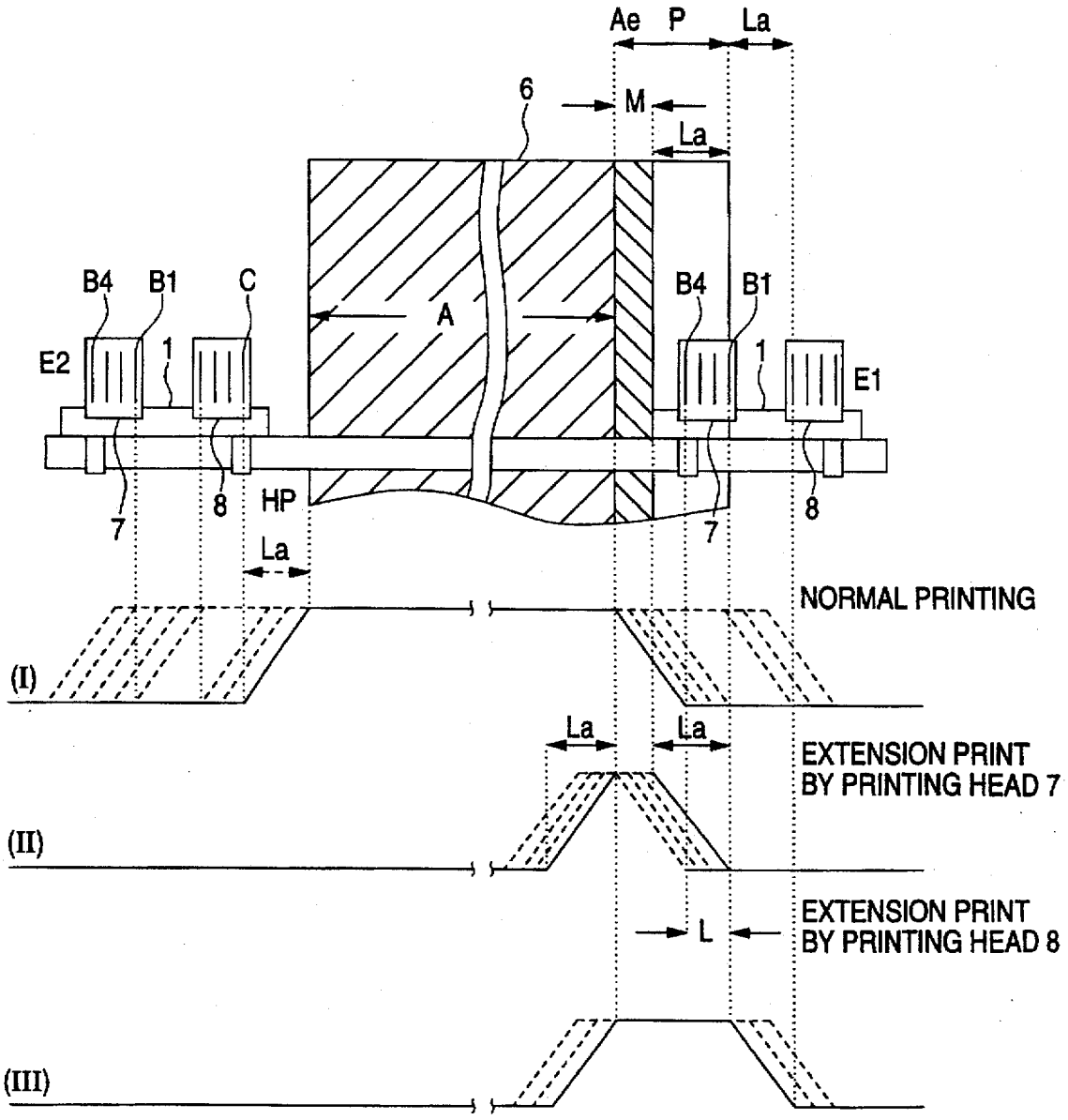

FIGS. 5(I), 5(II) and 5(III) show the movements of the carriage and printable regions in printing modes, as viewed from the front side of the printing heads.

Figure 6:
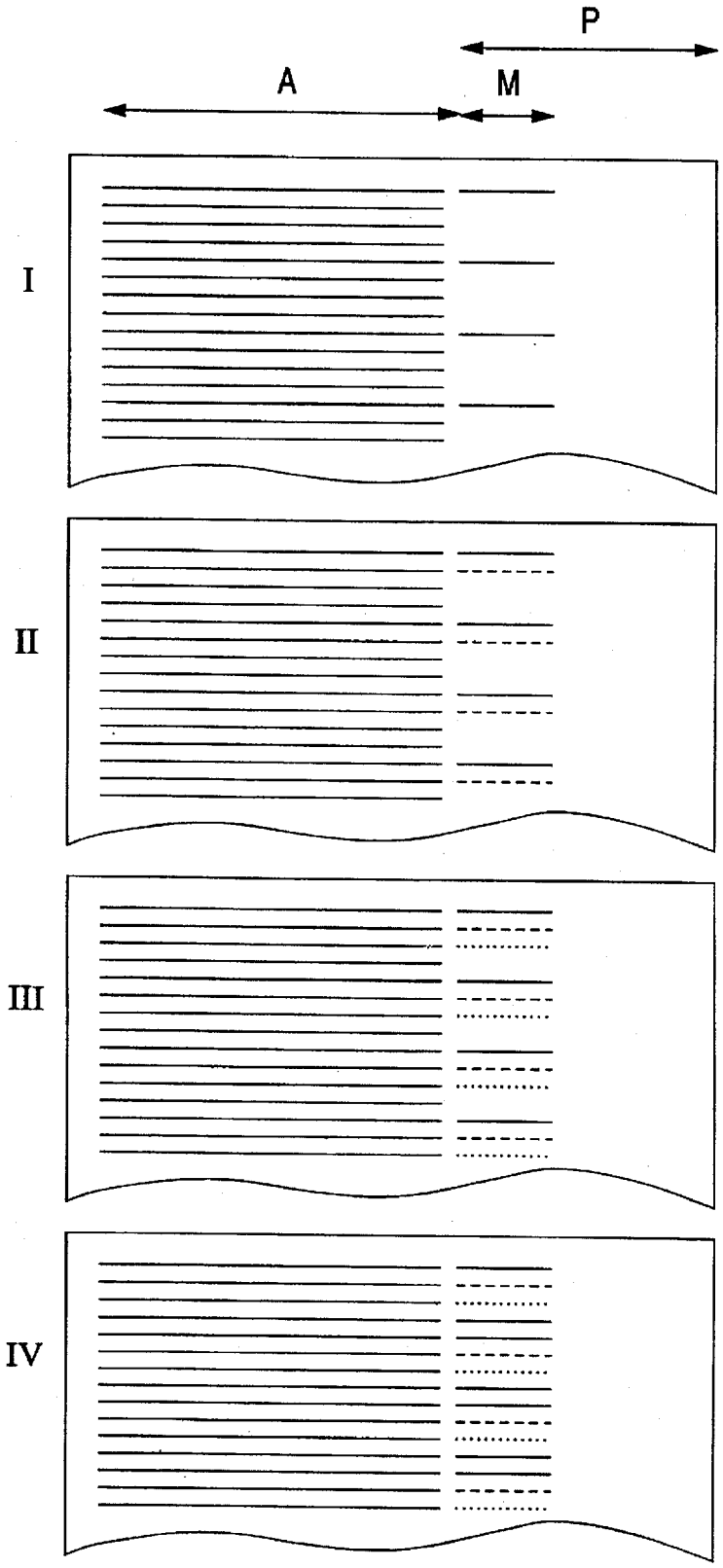

FIGS. 6(I), 6(II), 6(III) and 6(IV) are explanatory diagrams showing examples of printing by the ink jet printing device when it is operated in a normal print mode and an extension print mode.

DETAILED DESCRIPTION OF THE PREFERRED EMBODIMENTS

Figure 1:
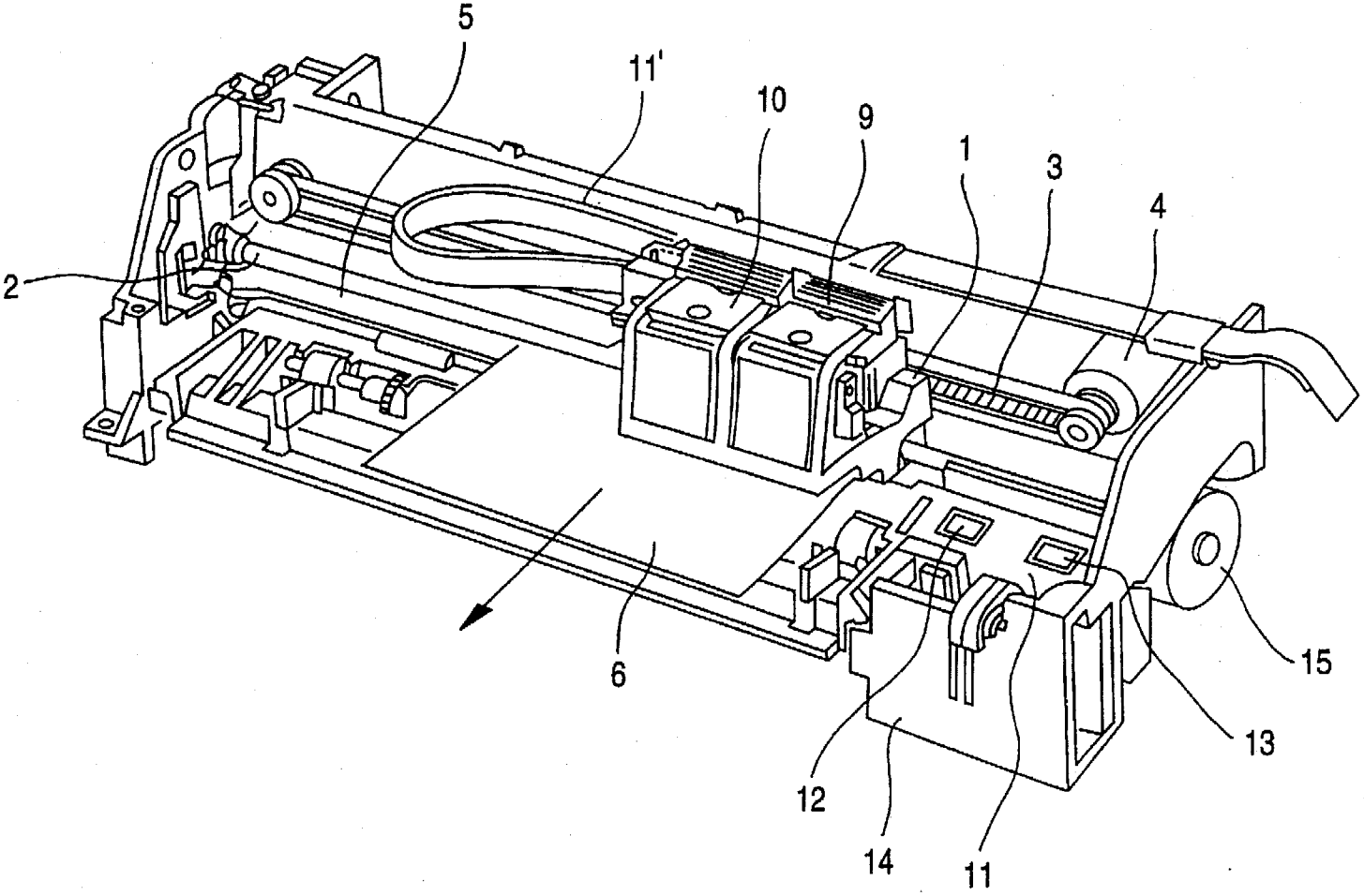
FIG. 1 is a perspective view showing an embodiment of an ink jet printing device according to the present invention.

FIG. 1 shows a serial printing device according to an embodiment of the present invention, including a carriage 1. The carriage 1 is supported by a guide member 2, and coupled with a stepping motor 4 by way of a timing belt 3. The carriage 1 is reciprocally movable in parallel with a platen 5.

Figure 2:
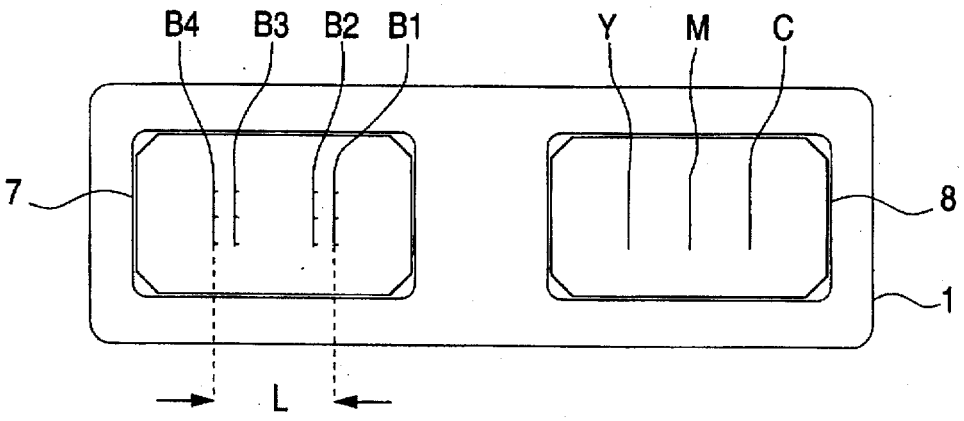
FIG. 2 is a view showing an array of monochromatic and color printing heads on a carriage of the ink jet printing device.

A first ink jet printing head 7 for jetting black ink and a second ink jet printing head 8 for jetting color ink are mounted on the carriage 1 (FIG. 2). These printing heads are spaced apart from each other in the moving direction of the carriage 1, and the first printing head 7 is located closer to the home position (the right end in the figure). A black ink cartridge 9 and a color ink cartridge 10 are located above the first and the second ink jet printing heads 7 and 8, respectively.

Reference numeral 11 designates a capping means, which is provided in a nonprinting region located closer to the home position. The capping means 11 includes capping members 12 and 13 for capping the nozzle-opening contained surfaces of the first and the second printing heads 7 and 8 in a sealing fashion. When the recovery of the jetting ability of the printing heads is required, these capping members 12 and 13 receive a negative pressure from a suction pump unit 14. Reference numeral 11' designates a flexible cable.

Reference numeral 15 designates a paper feeding motor. In a normal print mode, the paper feeding motor 15 feeds a printing paper 6 line by line. In an extension print mode to be described later, it feeds the paper 6 in smaller increments, e.g., dot by dot. The operation of the paper feeding motor 15 is controlled by paper-feed control means 23 (FIG. 4), which is described in detail hereinafter.

Figure 3:
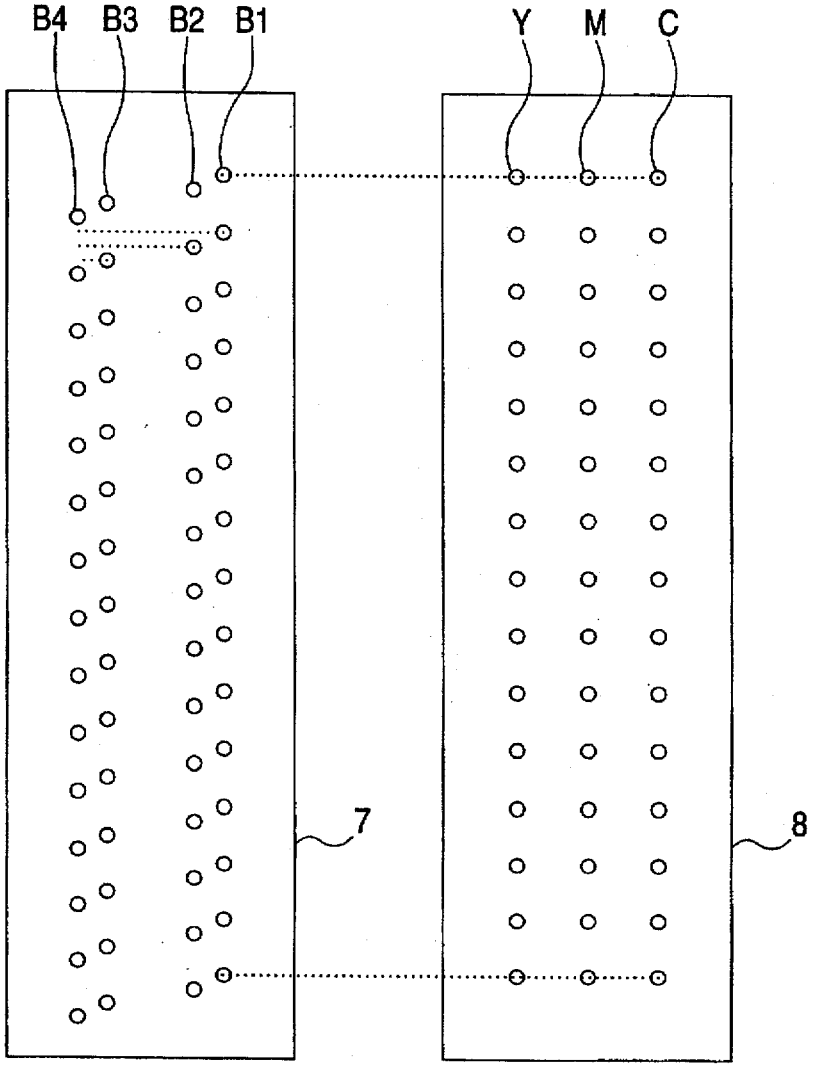
FIG. 3 is a view showing nozzle arrays on-the monochromatic and color printing heads.

FIG. 3 shows arrays of nozzle openings on the first and the second printing heads 7 and 8 when those heads are viewed from the rear sides thereof.

In the first printing head 7 for monochromatic printing, a plural number of series of nozzle openings are longitudinally arrayed on the printing head. In the present embodiment, four series of nozzle openings B1, B2, B3 and B4 are confined within a space defined by distance L (FIG. 2).

In the second printing head 8 for color printing, three series of nozzle openings for shooting forth ink of three colors, yellow (Y), magenta (M) and cyan (C) are arrayed on the printing head.

The three nozzle opening series Y, M and C for color printing are linearly extended in the moving direction of the carriage.

Of the four nozzle opening series B1 to B4, the nozzle opening series B1 is located closest to the second printing head 8 for color printing. The nozzle openings of the series B1 are horizontally aligned with those of the nozzle opening series Y, M and C, respectively.

The nozzle openings of the remaining nozzle opening series B2 to B4 are linearly arrayed at fixed pitches in the vertical direction (paper feeding direction) such that when horizontally viewed, the nozzle openings of those series B2 to B4 are located between the adjacent nozzle openings of the nozzle opening series B1. Such an arrangement of the nozzle opening series and their nozzle openings in the first printing head 7 for monochromatic printing achieves an intended resolution, e.g., 360 DPI, by one path motion for printing.

In the second printing head 8 for color printing, the nozzle openings of the nozzle opening series Y, M and C are vertically arrayed every four nozzle openings of the first printing head 7 for monochromatic printing. In other words, those nozzle openings are arrayed so as to achieve the resolution that is ¼ (90 DPI) of that of the first printing head 7. One line is printed by four path motions as the paper is fed in small increments, e.g., dot by dot.

Figure 4:
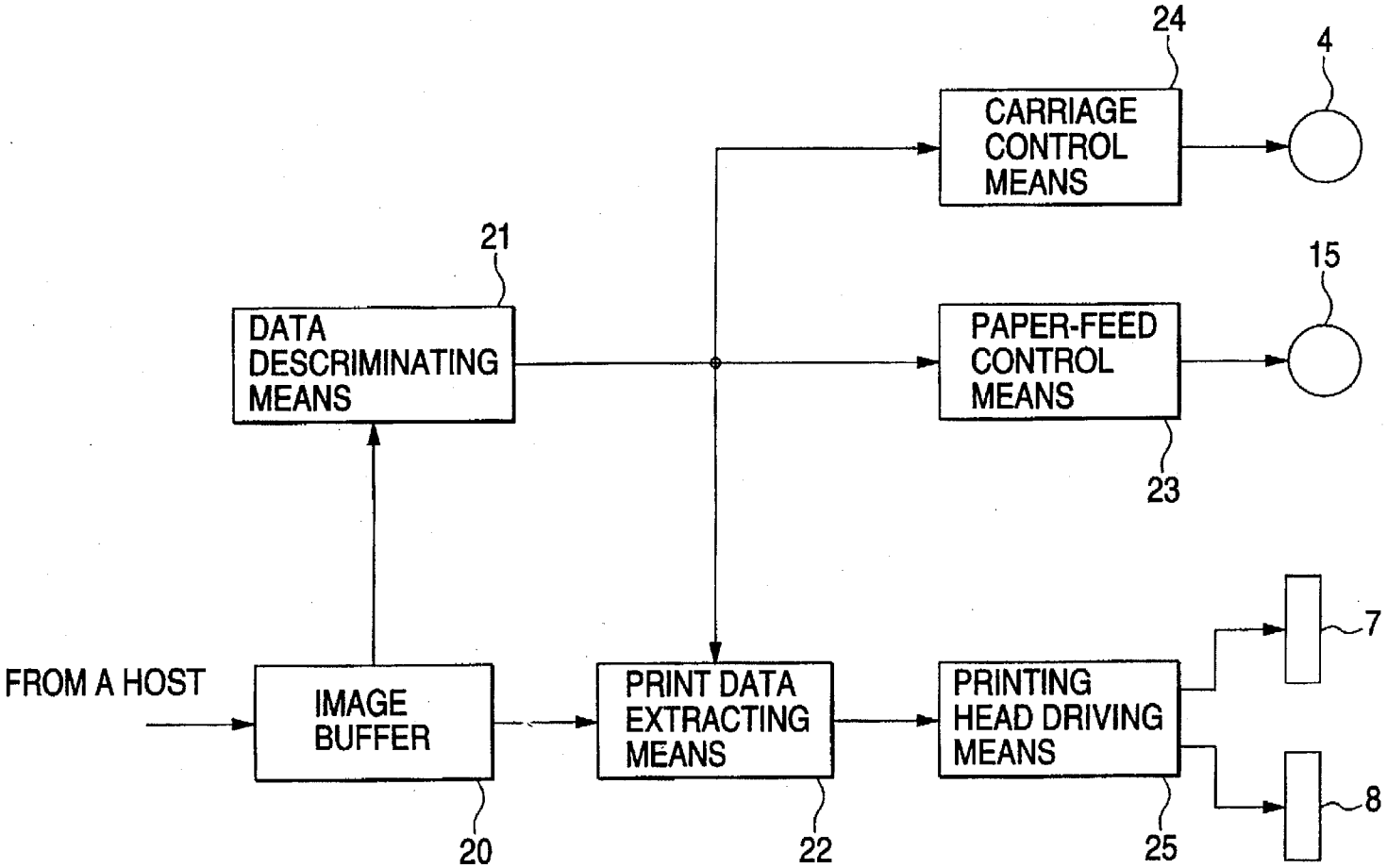
FIG. 4 is a block diagram showing control means used in the ink jet printing device.

FIG. 4 is a block diagram showing an example of a print control unit incorporated into the serial printing device according to the present invention.

In FIG. 4, an image buffer 20 stores image data received from a host computer. Data discriminating means 21 receives print data and discriminates the type of the received print data, viz., the print data to be printed for a region (denoted as A in FIG. 6) where monochromatic printing is performed or the print data to be printed for another region (denoted as M in FIG. 6) that is extended from the normal printing region A. The operation mode of the printing for region A is referred to as a normal print mode. The operation mode of the printing for region M is referred to as an extension print mode. A graphic printing process is an example of the printing process carried out in the extension print mode.

In the normal print mode, the print data extracting means 22 extracts print data from the image buffer 20, and transfers it to all of the dot forming elements. In the extension print mode, the print data extracting means 22 extracts the print data, which corresponds to the nozzle opening series B1 furthest from the printing region of the first printing head 7, from the image buffer 20, and transfers the image data to the nozzle opening series B1.

The paper-feed control means 23 operates in the following ways. In the normal print mode, when the printing of one path is completed, the paper-feed control means 23 feeds a printing paper by one line. In the extension print mode, when the printing of one path is completed, the control means 23 feeds the paper by a smaller increment, e.g., one dot, in connection with the pitch of the arrayed nozzle openings of the nozzle opening series B1.

In the normal print mode, the carriage control means 24 moves the carriage 1 from a home position HP to the normal printing region A. In the movement, as shown in FIG. 5, the carriage 1 is first accelerated (approach run La) from the home position HP, moved at a constant speed in the normal printing region A, decelerated at the position where the normal printing region A terminates, and stopped at an end point E1.

In the extension print mode, the carriage 1 is accelerated (approach run La) as in the normal print mode, and moved at a constant speed so as to allow at least the nozzle opening series B1 to print an image in an extension printing region M.

In FIG. 4, reference numeral 25 designates a printing head driving means for driving the printing heads 7 and 8 on the basis of the data derived from the image buffer 20.

The operation of the serial printing device thus constructed will be described with reference to FIG. 5. In particular, a monochromatic printing operation of the printing device is described.

Print data outputted from the host computer arrives at the image buffer 20. The print data is developed into bit map data in the buffer. The data discriminating means 21 checks to see whether the print data that is developed in the image buffer 20 contains the data to be printed in the extension printing region M, which is located on the right side of the printing paper.

If only the data to be printed for the normal printing region A is present in the image buffer 20, the print data extracting means 22 reads the print data out of the image buffer 20 while making the data correspond to the nozzle opening series B1 to B4 of the first printing head 7. The carriage control means 24 accelerates the carriage 1, and when the speed of the carriage 1 reaches a constant speed, the print data extracting means 22 outputs to the printing head to start the printing operation. When the carriage 1 reaches the terminal point Ae of the normal printing region A, the carriage control means 24 decelerates the carriage 1 and stops it at the end point E1. In this way, the printing operation of one line is performed. At the end of the one-line printing, the paper-feed control means 23 drives the paper feeding motor 15 so as to feed the printing paper by one line.

If the print data to be printed for the extension printing region M located further to the right than the normal printing region A is present in the image buffer 20, the printing operation is performed for the normal printing region A in the normal print mode, and is brought to an end. At the end of the printing operation for the normal printing region A, the carriage 1 is decelerated and stops at the end point E1.

When the carriage 1 stops, the print data extracting means 22 extracts only the print data corresponding to the first nozzle opening series B1 that is located furthest from the printing region of the first printing head 7, while the carriage control means 24 turns the movement of the carriage 1 at the end point E1 in the opposite direction, and accelerates the carriage 1 to move it toward the printing paper.

The carriage 1, which moves from the end point E1 to the home position HP, is accelerated. In this case, it is noted that a distance for acceleration of the nozzle opening series B1 of the first printing head 7 to the printing paper is longer than that of the nozzle opening series B4 located at the left end by the distance L between the nozzle opening series B1 and B4 (FIG. 2). Therefore, when the nozzle opening series B1 reaches the end of the paper, the speed of the carriage 1 has reached the constant speed for printing.

When the nozzle opening series B1 of the first printing head 7 reaches the printing position, the extracted print data is outputted to the nozzle opening series B1. Then, the printing is performed, and the image is printed in a state that the lines of the dot forming elements arrayed at the pitch, which is equal to the pitch of the arrayed nozzle openings of the nozzle opening series B1, are printed. These printed lines are the first, fifth, ninth, thirteenth, . . . lines in this instance (FIG. 6(I)).

When the printing for the extension printing region M is completed, the carriage control means 24 decelerates the carriage 1 and stops it at a preset position. Then, the carriage control means 24 moves the carriage 1 to the end point E1 again and the paper-feed control means 23 feeds the paper by one dot.

Of the data for the extension printing region M, the print data for the lines which are shifted from the lines printed in the previous printing operation, i.e., the second, sixth, tenth, fourteenth, . . . lines, is extracted by the print data extracting means 22. The carriage 1 is moved again toward the home position HP as in the previous printing operation. When it reaches the left end of the paper, the printing operation starts, to thereby print dots under the line previously printed (FIG. 6(II)).

Such a printing operation is repeated a plural number of times, e.g., two times in the present embodiment, to thereby print the third, seventh, eleventh, fifteenth, . . . lines (FIG. 6(III)), and the fourth, eighth, twelfth, . . . lines (FIG. 6(IV)). As a result, the printing for the paper area corresponding to the width of one line (when viewed in the paper feeding direction) in the normal print mode is completed.

When the one-line printing for the normal printing region A and the extension printing region M is completed, the print control unit receives print data from the host computer and executes the printing in the paper feed direction by repeating the sequence of the printing operation as mentioned above.

The extension printing region M adjoining the normal printing region A may be used as a printing region for the line numbers in a text print. Accordingly, the line numbers may be printed in the right margin of the text without using the print region (region A) for the text.

Thus far, the monochromatic printing operation of the serial printing device in the extension print mode has been described. However, the second printing head 8 is located closer to the end point E1 than the normal printing region A, and the second printing head 8 can move at a constant speed over the entire width of the paper. In other words, normal printing can occur in region P because the acceleration/deceleration distance La can be subtracted from the distance to the end point E1. Therefore, in a color printer which uses a color printing head for the second printing head 8, a color scale, such as color samples, may be printed in the margin of the paper outside the normal printing region A.

The nozzle opening series B1, which is used in the extension print mode, contains the nozzle openings for printing the top line of the lines to be printed. Consequently, there is no need for reverse feeding of the paper when the paper is fed in small increments. Backlash, which is caused by reverse feeding, is therefore eliminated. The resultant print is free from banding caused by displacement of the head in the paper feeding direction.

In the above-described embodiment, the first printing head 7 for monochromatic printing is used for extension printing. Accordingly, printing is limited to the extension printing region M shown in FIG. 5.

By way of contrast, for the second printing head 8, the moving distance of the carriage 1 is selected so as to print a color image over the entire width of the paper in the normal print mode. Therefore, by using the three nozzle opening series Y, M and C of the second printing head 8 in place of the first printing head 7, it is possible to print in the entire region P including the region La.

When printing in the normal printing region A ends and the carriage 1 stops at the end point E1, the print data extracting means 22 extracts the print data corresponding to the nozzle opening series Y of the second printing head 8, and the carriage control means 24 reverses the carriage 1 in its moving direction and accelerates it toward the paper.

When the nozzle opening series Y of the second printing head 8 reaches the printing position at the right end of the printing paper, the print data extracted for the nozzle opening series Y is outputted to the nozzle opening series Y. The same data is also outputted to the remaining nozzle opening series M and C at preset time lags, successively. As a result, ink of yellow, cyan and magenta land on the printing paper along the same scan line in a superposed fashion (FIG. 5(III)). An image is printed in a state that only the first, fifth, ninth, thirteenth, . . . lines are colored with the composite ink, or are not printed.

When the printing for the region P is completed, the carriage control means 24 decelerates the carriage 1 and stops it at a preset position. Then, the carriage control means 24 moves the carriage 1 to the end point E1 again, and the paper-feed control means 23 feeds the paper by one dot.

Of the data corresponding to region P, the print data for the nozzle opening series Y is extracted by the print data extracting means 22, and only the second, sixth, tenth, fourteenth, . . . lines, which are shifted from the lines printed in the previous printing, are colored with the composite ink or not printed.

Subsequently, the printing for the region P is repeated while the scan line is shifted dot by dot by feeding the printing paper in small increments.

It is readily seen that an image may be printed with a color other than black by limiting the number of the nozzle opening series used for printing to 1 or 2 color nozzle opening series. If the line numbers, which are printed separately from the text, are printed with a color other than black, the printed line numbers are more easily seen and distinctly discriminated from the text. A color scale, such as color samples, may be printed in the region P.

Printing paper which is slightly larger than normal may be used for printing if the moving distance of the carriage in the extension print region is reduced, or if the paper transporting path is correspondingly selected.

Normally, the paper is fed in small increments only when printing in the extension print region. However, when the data discriminating means 21 determines that the data to be printed in the extension print mode is contained in the print data for one line, the same printing method as the extension printing method may be applied in printing the entire line including the normal printing region A.

An entire page can be checked to determine whether or not data is to be printed for the extension print region, and if such data is detected, the entire page may be printed by an intermittent printing method using the nozzle opening series B1 or the nozzle opening series Y, M and C, the printing method being based on the interlacing printing technique disclosed, for example, in U.S. Pat. No. 4,198,642.

It is possible that the storage capacity of the memory contained in the printing device is insufficient for storing print data of an entire page. As one solution, a memory area that is large enough to store the print data of one page may be provided in the memory of the host computer, and a data check function can be incorporated into the print driver contained in the host computer. Only the data of the print paths to be printed, when required, are outputted to the printing device through a communication line. When this solution is employed, the data discriminating means 21 (FIG. 4) can be excluded from the printing device.

In the above-mentioned embodiment, the expansion print region is located in the right margin on the printing paper. If required, it may be located in-the left margin. In this case, the first printing head 7 and the second printing head 8 are reversed in position. In other words, in FIG. 2, the first printing head 7 is located on the right side, and the second printing head 8 is located on the left side.

The serial printing device which is constructed as described above effectively uses the space between the dot forming element series, and reduces the moving distance of the carriage so as to create an increased printing area, which is larger than the printing area for normal printing.

What is claimed is:

1. A serial printing device comprising:

a serial printing head including a plural number of dot forming element series each comprising a plural number of dot forming elements linearly arrayed at fixed pitches in a printing medium feeding direction, said plural number of dot forming element series being arrayed in a printing medium width direction and being shifted from each other in the printing medium feeding direction;

a carriage on which said serial printing head is mounted, said carriage being reciprocally movable in the printing medium width direction;

control means for controlling a first printing process wherein, when a moving speed of said carriage reaches a constant speed for printing, print data is outputted to said serial printing head for printing an image of one line by one printing path, and for controlling a second printing process wherein the print data is outputted to one of the dot forming element series located closest to an end of said serial printing head in the printing medium width direction, and an image is printed in a plural number of printing paths by feeding the printing medium in the printing medium feeding direction in increments less than one line as each of said plural number of printing paths is completed; and data discriminating means for discriminating the first or the second printing process, based on the print data, and for selecting the discriminated printing process.

2. The serial printing device according to claim 1, wherein said one of the dot forming element series located closest to an end of said serial printing head has a dot forming element disposed along an uppermost scan line of each line in said first printing process.

3. The serial printing device according to claim 1, wherein, when the print data corresponds to an extended printing region outside a normal text printing region, said control means controls said second printing process so that said second printing process is carried out only in the extended printing region.

4. The serial printing device according to claim 1, wherein, when the print data corresponds to an extended printing region outside a normal text printing region, said control means controls said second printing process so that said second printing process is carried out for printing an entire line.

5. A serial printing device comprising:

a first serial printing head including a plural number of dot forming element series each comprising a plural number of dot forming elements linearly arrayed at fixed pitches in a printing medium feeding direction, said plural number of dot forming element series being arrayed in a printing medium width direction and being shifted from each other in the printing medium feeding direction;

a second serial printing head including a plural number of dot forming element series, said plural number of dot forming element series being arrayed side by side in the printing medium width direction and aligned in the printing medium width direction with the dot forming elements of one of said plural number of dot forming element series of said first serial printing head, colors of dots formed by the dot forming elements of said second serial printing head being different from a color of dots formed by the dot forming elements of said first serial printing head;

a carriage on which said first and second serial printing heads are mounted, said carriage being reciprocally movable in the printing medium width direction;

control means for controlling a first printing process wherein, when a moving speed of said carriage reaches a constant speed for printing, print data is outputted to said first serial printing head for printing an image of one line by one printing path, and for controlling a second printing process wherein the print data is outputted to said second serial printing head, and an image is printed in a plural number of printing paths by feeding the printing medium in the printing medium feeding direction in increments less than one line as each of said plural number of printing paths is completed; and data discriminating means for discriminating the first or the second printing process, based on the print data, and for selecting the discriminated printing process.

6. The serial printing device according to claim 5, wherein said plural number of dot forming element series of said second serial printing head are aligned with an uppermost scan line of each line in said first printing process.

7. The serial printing device according to claim 5, wherein said second serial printing head is an ink jet printing head for jetting ink droplets of yellow, magenta and cyan.

8. The serial printing device according to claim 5, wherein, when the print data corresponds to an extended printing region outside a normal text printing region, said control means controls said second printing process so that said second printing process is carried out only in the extended printing region.

* * * * *